US009482439B2

(12) United States Patent
Akhtar

(10) Patent No.: US 9,482,439 B2
(45) Date of Patent: Nov. 1, 2016

(54) AIR HANDLING DEVICE

(76) Inventor: Salman Akhtar, Kitchener (CA)

( * ) Notice: Subject to any disclaimer, the term of this patent is extended or adjusted under 35 U.S.C. 154(b) by 977 days.

(21) Appl. No.: 13/269,665

(22) Filed: Oct. 10, 2011

(65) Prior Publication Data

US 2013/0090052 A1 Apr. 11, 2013

(51) Int. Cl.

| | |
|---|---|
| ***F24F 7/06*** | (2006.01) |
| ***F24F 7/007*** | (2006.01) |
| ***F24F 3/044*** | (2006.01) |
| ***F24F 13/20*** | (2006.01) |

(52) U.S. Cl.

CPC ..... *F24F 3/044* (2013.01); *F24F 13/20* (2013.01); *F24F 2013/205* (2013.01)

(58) Field of Classification Search

CPC ..... F24F 13/24; F24F 7/007
USPC ..... 454/186, 234, 906; 181/224, 225
See application file for complete search history.

(56) References Cited

U.S. PATENT DOCUMENTS 2,050,581 A * 8/1936 Orem ..... F02M 35/14 181/229
3,960,063 A * 6/1976 Siemes ..... F24F 13/24 181/224
4,418,788 A * 12/1983 Gorchev ..... F16L 55/033 181/224
4,498,913 A * 2/1985 Tank ..... B05B 15/1248 118/DIG. 7
4,531,956 A * 7/1985 Howorth ..... A61G 13/108 454/187
4,986,170 A * 1/1991 Ramakrishnan ..... F24F 7/08 181/224
4,996,910 A * 3/1991 Howorth ..... F24F 3/1607 454/57
5,426,268 A * 6/1995 Yazici ..... F24F 7/08 181/224
5,473,124 A * 12/1995 Yazici ..... F24F 13/24 181/224
5,587,563 A * 12/1996 Yazici ..... F24F 7/08 181/224
5,588,985 A * 12/1996 Shagott ..... A47L 5/38 15/347
5,663,535 A * 9/1997 MacDonald ..... F24F 13/24 181/224
5,728,979 A * 3/1998 Yazici ..... F24F 7/08 181/224
5,735,738 A * 4/1998 Kuno ..... F24F 13/22 454/296
5,910,045 A * 6/1999 Aoki ..... F04D 17/02 454/186
6,027,406 A * 2/2000 Yazici ..... F04D 29/601 181/224
6,102,153 A * 8/2000 Willke, Jr. ..... F24F 13/24 181/224
6,267,665 B1 * 7/2001 Akhtar ..... F24F 7/007 181/224
6,402,612 B2 * 6/2002 Akhtar ..... F24F 7/007 181/224

(Continued)

*Primary Examiner* — Steven B McAllister
*Assistant Examiner* — Jonathan Cotov
(74) *Attorney, Agent, or Firm* — Carlson, Gaskey & Olds, P.C.

(57) ABSTRACT

An air handling device includes a fan that has a fan hub and a set of fan blades that extend from the fan hub. The set of fan blades defines a fan diameter and the fan hub defines a hub diameter. The fan has an inlet side for air intake and an outlet side for air discharge. An annular fan inlet passage is arranged at the inlet side of the fan, and an annular fan outlet passage arranged at the outlet side of the fan. The fan inlet passage and the fan outlet passage each define an outer diameter that is substantially equivalent to the fan diameter and an inner diameter that is substantially equivalent to the hub diameter.

15 Claims, 5 Drawing Sheets

(56) References Cited

U.S. PATENT DOCUMENTS 6,419,576 B1 * 7/2002 Han ..... F04D 29/664 181/224
6,431,975 B1 * 8/2002 Ryan ..... B08B 15/023 141/93
6,457,550 B1 * 10/2002 Barry ..... F24F 13/24 181/222
6,537,490 B2 * 3/2003 Han ..... F01D 25/30 181/224
6,688,966 B2 * 2/2004 Akhtar ..... F24F 3/0442 165/249
6,736,238 B2 * 5/2004 Kerr ..... F04D 29/663 181/229
6,802,690 B2 * 10/2004 Han ..... F01D 25/30 138/37
6,880,813 B2 * 4/2005 Yazici ..... F28C 1/10 181/224
7,878,299 B2 * 2/2011 Geyer, III ..... F01N 1/082 181/229
8,025,477 B2 * 9/2011 Ganesh ..... F04D 29/441 415/1
8,354,057 B2 * 1/2013 Heselton ..... A61L 2/202 204/176
2003/0072648 A1 * 4/2003 Han ..... F01D 25/30 415/119
2003/0192737 A1 * 10/2003 Han ..... F01D 25/30 181/224
2008/0070493 A1 * 3/2008 Rimmer ..... F24F 1/0007 454/186
2008/0194195 A1 * 8/2008 Duke ..... F24F 13/24 454/262
2008/0223652 A1 * 9/2008 Dyck ..... E04F 17/04 181/224
2014/0220881 A1 * 8/2014 Masuda ..... F04D 25/12 454/333

* cited by examiner

AIR HANDLING DEVICE

BACKGROUND OF THE INVENTION

This disclosure relates to air handling systems for supplying conditioned air to a building or other structure.

Conventional air handling systems are known and used to supply conditioned air to a room, a building or other structure. For instance, air handling systems typically include an air handling unit that is generally enclosed within a housing. The air handling unit may include an inlet for the intake of air and an outlet for the discharge of conditioned air. A fan is arranged between the inlet and the outlet for drawing in air and discharging conditioned air. The air handling unit may also include a heat exchange coil for heating or cooling the air and one or more filters for removing particles or dust from the air.

SUMMARY

Disclosed is an air handling device that includes a fan that has a fan hub and a set of fan blades that extend from the fan hub. The set of fan blades defines a fan diameter and the fan hub defines a hub diameter. The fan has an inlet side for air intake and an outlet side for air discharge. An annular fan inlet passage is arranged at the inlet side of the fan, and an annular fan outlet passage arranged at the outlet side of the fan. The fan inlet passage and the fan outlet passage each define an outer diameter that is substantially equivalent to the fan diameter and an inner diameter that is substantially equivalent to the hub diameter.

BRIEF DESCRIPTION OF THE DRAWINGS

The various features and advantages of the disclosed examples will become apparent to those skilled in the art from the following detailed description. The drawings that accompany the detailed description can be briefly described as follows.

DETAILED DESCRIPTION OF THE PREFERRED EMBODIMENT

Figure 1:
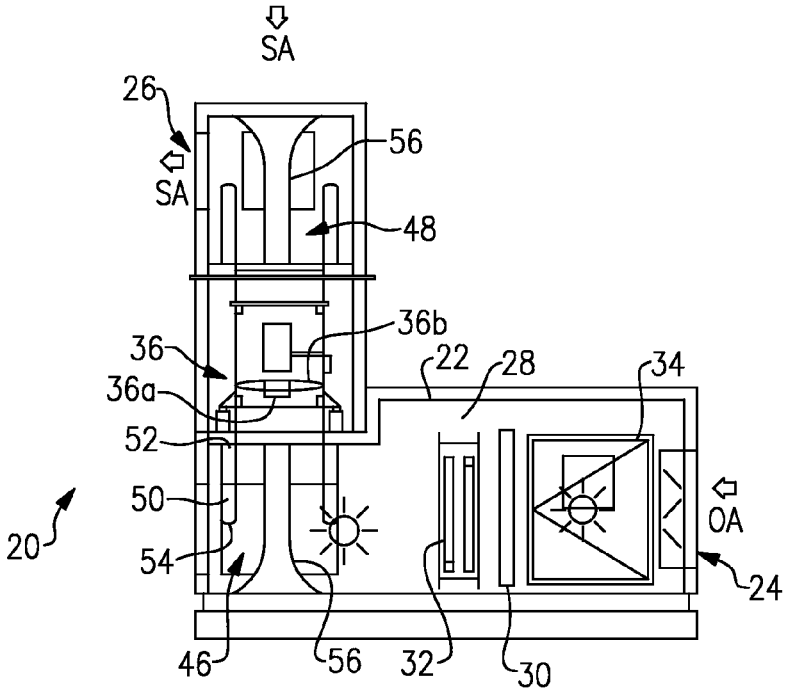
FIGS. 1-3 show different views of an example air handling device.
Figure 2:
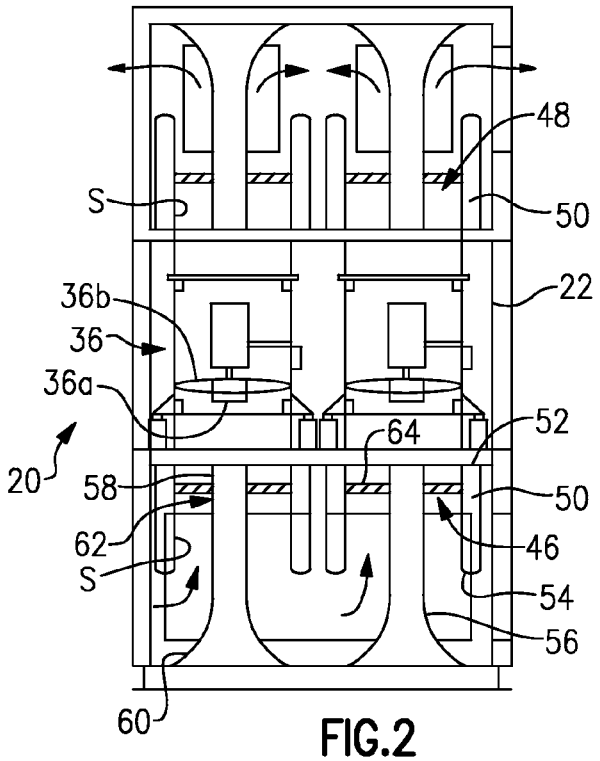
Figure 4:
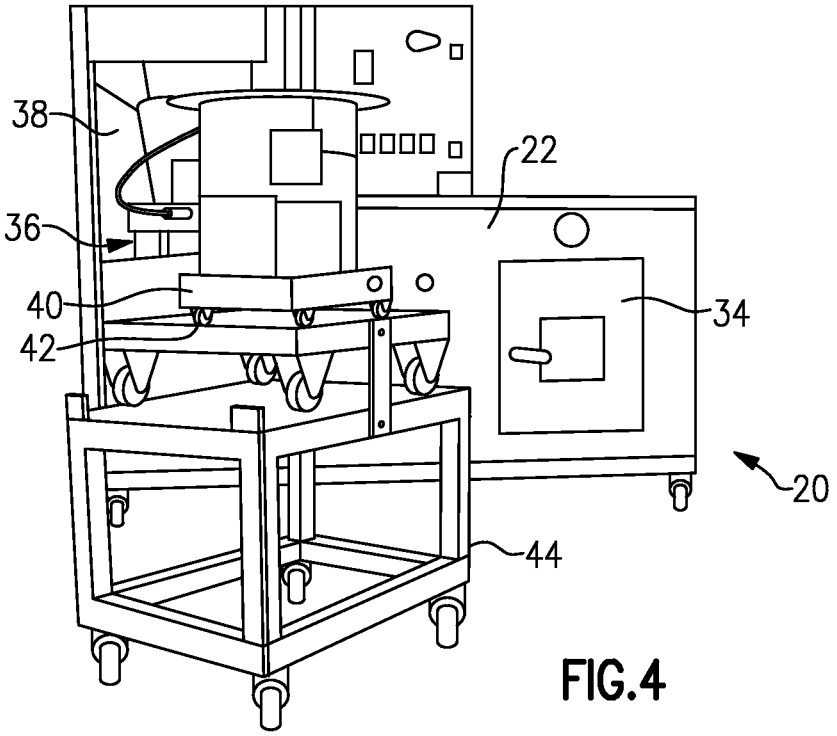
FIG. 4 shows an example air handling device with one of the fans removed.
Figure 3:
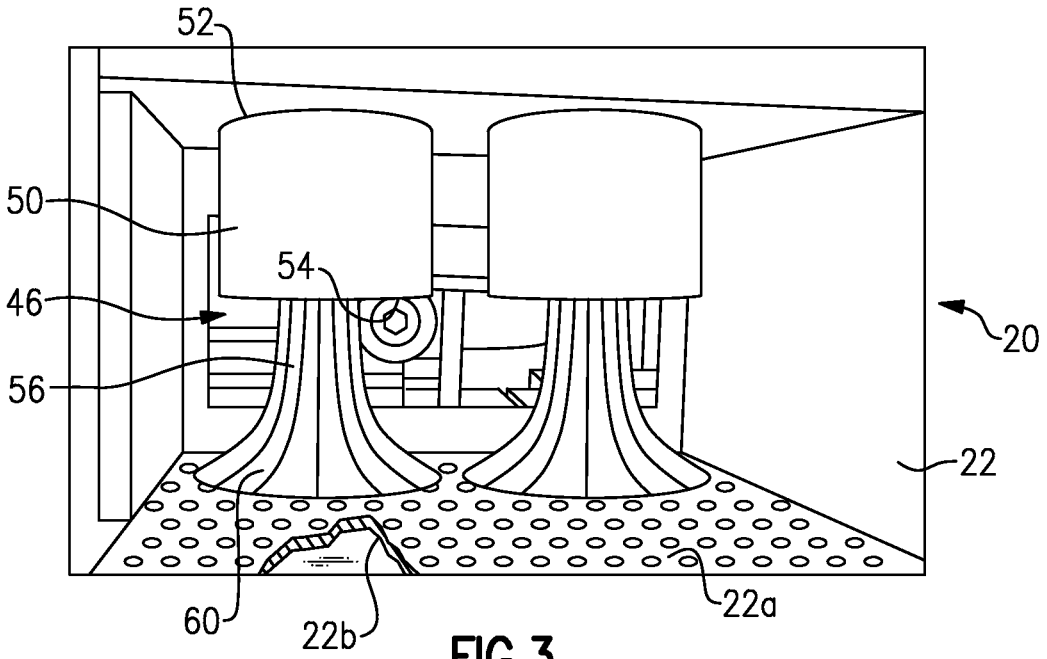

FIGS. 1-4 show different views of an example air handling device 20 for supplying air to the interior of a building, for example. More specifically, FIG. 1 shows a side cross-sectional view of the air handling device 20, FIG. 2 shows a different side cross-sectional view of the air handling device 20, FIG. 3 shows a perspective view of a portion of the air handling device 20 and FIG. 4 shows a view of the air handling device 20 with one of the fans removed. As will be described in more detail below, the disclosed air handling device 20 provides the advantage of flexibility in that one or more of the fans can be easily removed for maintenance, replacement or the like. Furthermore, as will also be described, the air handling device 20 includes features for efficient and quiet operation.

In the illustrated example, the air handling device 20 includes a housing 22 that generally defines an inlet 24 for the intake of air and an outlet 26 for the discharge of conditioned air. The housing 22 generally defines an open interior space 28 in which a prefilter 30 and one or more heat exchange coils 32 are located for conditioning air received through the inlet 24. It is to be understood that the configuration with regard to any filters and heat exchange coils can be modified from the illustrated example to meet the needs of a particular application. The housing 22 also includes an optional access panel 34 for providing access to the prefilter 30 and coils 32 for maintenance, replacement or the like.

A bank of fans 36 is arranged downstream from the prefilter 30 and coils 32, relative to the inlet 24 and outlet 26, for moving the air between the inlet 24 and the outlet 26. In this example, the fans 36 are electric motor-driven axial flow fans that are arranged vertically such that the axis of rotation of each of the fans 36 is vertically oriented. It is to be understood, however, that the fans 36 may alternatively be arranged horizontally or at any angle between horizontal and vertical. In one alternative, the fans 36 are centrifugal fans instead of axial flow fans and may also be arranged horizontally, vertically or at any angle there between.

As illustrated in FIG. 4, one beneficial feature of the exemplary air handling device 20 is that the air handling device 20 is optionally designed for easy removal of one or more of the fans 36. In the illustrated example, the housing 22 of the air handling device 20 can include at least one access window 38 (i.e. opening) that allows for easy installation and removal of the fans 36. The access window 38 includes an opening in the housing 22 and is suitably sized to receive at least one of the fans 36 there through. That is, the opening is at least as large as the individual fans 36. Optionally, the access portion 38 can include a moveable or removable access door for enclosing the fans 36 within the housing 22 during operation.

In the illustrated example, the bank of fans 36 includes two such fans. It is to be understood that in other examples the bank of fans 36 may include additional fans, depending on the requirements of the system. As shown, the two fans 36 are arranged side-by-side. In other examples that utilize additional fans 36, the additional fans may also be arranged side-by-side in a row. In a further example, the fans 36 are arranged in an array or matrix that includes a plurality of rows.

As shown most clearly in FIG. 4, each of the fans 36 has a base 40 that permits easy installation and removal of the fan 36 through the access portion 38. That is, the base 40 includes sliding surfaces 42 for sliding the fans 36 in and out of the housing 22. In embodiments, the sliding surfaces 42 of the base 40 of the fans 36 include castors and/or an anti-friction material, such as a polymeric material, that facilitates sliding movement of the fans 36 into or out of the housing 22.

Optionally, the air handling device 20 may be provided with a transport device 44 that is adapted to receive and securely support at least one of the fans 36 for moving one or more of the fans 36. In the illustrated example, the transport device 44 is a cart that is of suitable height such that the top of the cart approximately aligns with the bottom of the access portion 38 of the housing 22. Thus, the height of the cart allows the fans 36 to be removed from the housing 22 through the access portion 38 and onto the cart. Similarly, the height of the cart also allows a fan 36 that is on the cart to be slid from the cart through the access window 38 and into the housing 22. Thus, the fans 36 can be readily installed into the housing 22, removed for maintenance or easily replaced. Once in the housing 22, the fans 36 can be secured in place using bolts or other fasteners.

As shown in FIGS. 1 and 2, each of the fans 36 includes a hub 36*a* and a set of fan blades 36*b* that extend from the hub 36*a*. The set of fan blades 36*b* defines a fan diameter and the fan hub 36*a* defines a hub diameter. In the illustration, each fan 36 has an inlet side below the set of fan blades 36*b* for air intake and an outlet side above the set of fan blades 36*b* for air discharge.

Each of the fans 36 further includes a fan inlet 46 and a fan outlet 48 for, respectively, intake of air into the fans 36 and discharge of the air from the fans 36. As will be described, the inlets 46 and outlets 48 are designed for efficient and quiet movement of the air.

In the illustrated example, each of the fan inlets 46 and fan outlets 48 includes a housing portion 50 defining a cylindrical internal space S having a diameter that is substantially equal to the diameter of the fans 36. Each of the housing portions 50 extends between a first end 52 near its respective fan 36 and a second end 54 located farther away from the fan 36. Air guide members 56 extend through the interior of each of the housing portions 50. As shown, each of the air guide members 56 extends between a first end 58 near its corresponding fan 36 and a second end 60 located farther away from the fan 36.

Each air guide member 56 includes a substantially cylindrical portion 62 that extends from the first end 58 and in the respective housing portion 50 such that there is an annular passage defined between the inner diameter of the housing portions 50 and an outer diameter of the cylindrical portion 62. Each cylindrical portion 62 is substantially equal in diameter to the diameter of the hub 36*a*. Thus, the diametrical distance over which each annular passage extends between the respective cylindrical portion 62 and the corresponding housing portion 50 is substantially equal to the span of the blades 36*a* from the hubs 36*b*.

Each annular passage extends over an axial length defined between the first end 52 and the second end 54 of the corresponding housing portion 50. In one example, the axial distance is greater than the diametrical distance of the annular passage. That is, an aspect ratio of the axial length divided by the diametrical distance is greater than one.

Each of the air guide members 56 extends from the interior of the housing portions 50 beyond the second ends 54 and gradually increases in diameter to the terminal second end 60. Thus, the shape of the air guide members 56 provides a uniform size annular passage between the air guide member 56 and the housing portions 50 and a non-uniform passage beyond the second ends 54 of the housing portions 50.

Optionally, the housing 22 may also include one or more perforated surfaces 22*a* (FIG. 3) located near the fan inlets 46 and/or fan outlets 48. The perforated surfaces 22*a* are backed by a liner material 22*b* of insulation that is made out of plastic or cloth. The combination of the perforated surface 22*a* and the liner material 22*b* provides the benefit of sound attenuation within the air handling device 20.

As shown in FIGS. 2 and 3, the housing portions 50 of the fan inlets 46 and fan outlets 48 are spaced apart from the neighboring housing portion 50. Thus, each fan 36 includes its own fan inlet 46 and fan outlet 48. Moreover, the housing portions 50 and the spacing between the housing portions 50 function as baffles within the interior of the housing 22 to mix air near the fan inlets 46 and, at the discharge end, mix air discharged through the fan outlets 48.

Optionally, as shown in FIG. 2, at least one of the annular passages of the air handling device 20 includes at least one vane 64. Each such vane 64 extends from a respective air guide member 56 to the corresponding housing portion 50. In a further example, each annular passage includes a plurality of vanes 64 that are circumferentially spaced around a respective air guide member 56.

In operation, the fan inlets 46 and the fan outlets 48 facilitate efficient and quiet operation of the air handling device 20. At the fan inlets 46, the housing portions 50 and air guide members 56 prepare the air to enter the fans 36. In one example, when the air enters through the inlet 24 of the housing 22, the air is moving relatively slowly. As the air encounters the gradually increasing diameter of the air guide members 56 and begins to turn into the annular space between the housing portions 50 and the air guide members 56, the air accelerates gradually and thereby reduces pressure loss that can otherwise occur when air rapidly increases in velocity. Thus, the air guide members 56 and housing portions 50 passively gradually accelerate the air in preparation for entry into the area of the fans 36.

Likewise, air discharged from the fans 36 enters into the annular space at the fan outlets 48 between the housing portions 50 and the air guide members 56. As the air exits the housing portions 50 and encounters the increasing diameter of the air guide members 56, the air gradually decelerates. The gradual deceleration induced by the shape of the air guide members 56 streamlines deceleration for regain of pressure and overall lower pressure losses that can otherwise occur with more rapid deceleration.

In further embodiments where the axial lengths of the annular passages are greater than the diametrical distances of the annular passages, the aspect ratio of the annular passages facilitates stabilization of air flow for more efficient operation. That is, the air flow may include turbulent flow, and the aspect ratio serves to straighten the flow and reduce turbulence. The turbulent flow can be due to the change in flow direction over the gradually increasing diameter portions of the air guide members 56 and/or a natural "swirl" within the air received into the air handling device 20.

In further embodiments that include one or more vanes 64 within one or more of the annular passages, the vanes 64 facilitate stabilization of air flow for more efficient operation. That is, the vanes 64 serve to straighten the flow and reduce turbulence.

Figure 6:
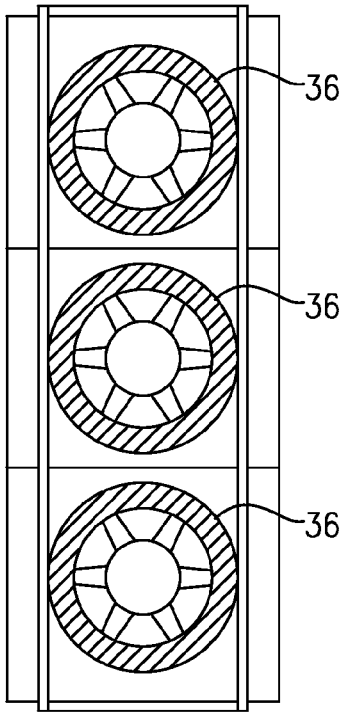
FIG. 6 shows a bank of fans of the air handling device of FIG. 5.
Figure 5:
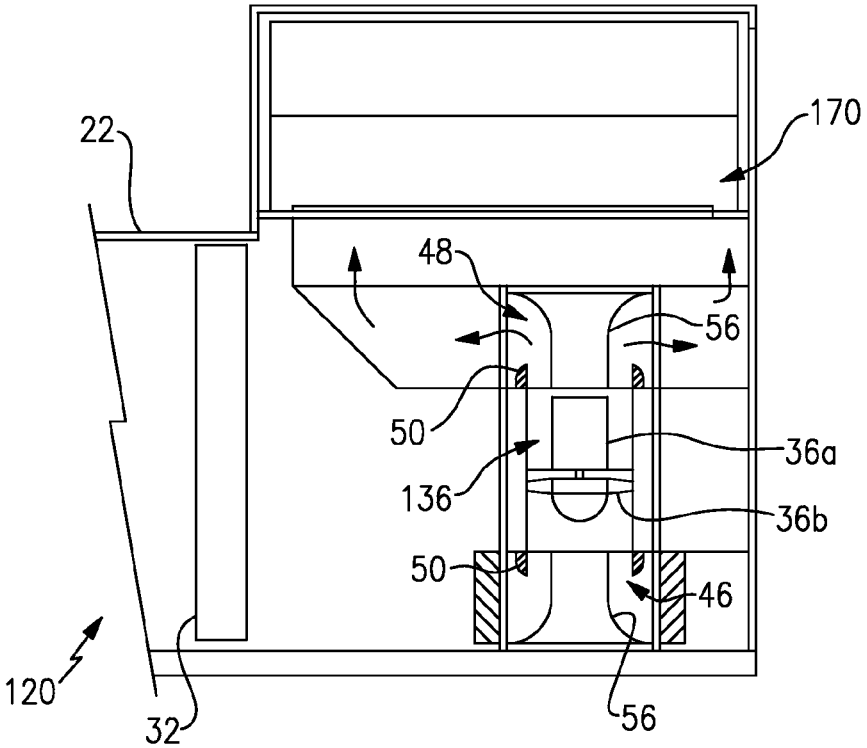
FIG. 5 shows another example air handling device.

FIG. 5 shows another example air handling device 120. In this disclosure, like reference numerals designate like elements where appropriate, and reference numerals with the addition of one-hundred or multiples thereof designate modified elements. The modified elements are understood to incorporate the same features and benefits of the corresponding elements. In this example, the air handling device 120 is somewhat similar to the air handling device 20 previously described, but includes a bank of fans 136 that includes three fans, as shown in FIG. 6. In this example, each of the fans 36 is an axial fan, but may alternatively be a centrifugal fan. The fans 36 are arranged in a row and, as previously described, each include a fan inlet 46 and fan outlet 48 with corresponding housing portion 50 and air guide members 56 that operate substantially as described above.

Figure 7:
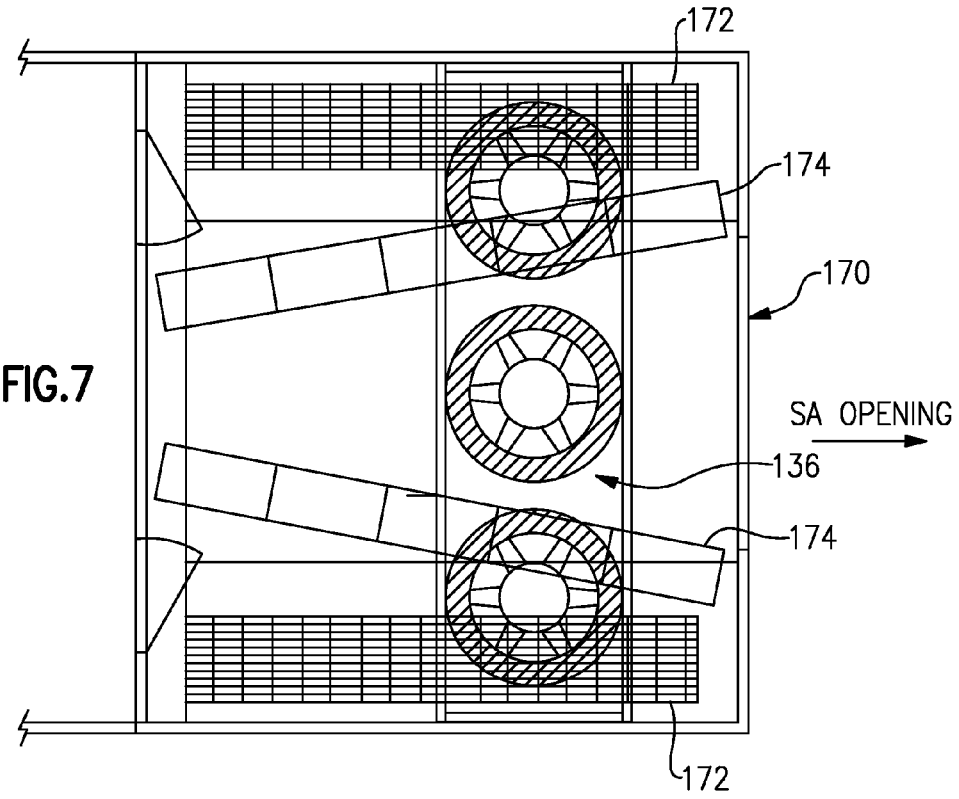
FIG. 7 shows a plenum box for use with the air handling device of FIG. 5.

In this example, the air handling device 120 also includes a plenum box 170 arranged above the bank of fans 136. As shown in FIG. 7, the plenum box 170 includes one or more grates 172 through which air is received from the bank of fans 136. The grates 172 are generally arranged toward opposite lateral sides of the plenum box 170 such that air received through the grates 172 is then forced through filters 174 before discharge of the air into the building or other structure.

Figure 8:
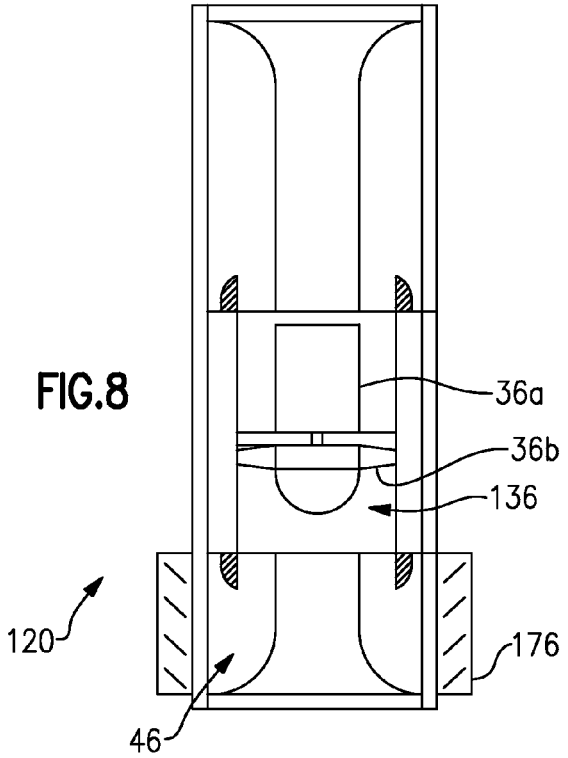
FIG. 8 shows dampers of the air handling device of FIG. 5.

Optionally, as shown in FIG. 8, the air handling device 120 (or 20) may also include dampers 176 for controlling the flow of air into the fan inlets 46. Each of the fans 136 may include its own set of dampers 176 or, alternatively, a single set of dampers 176 may be used to control flow of air to all of the fans 136.

Figure 9:
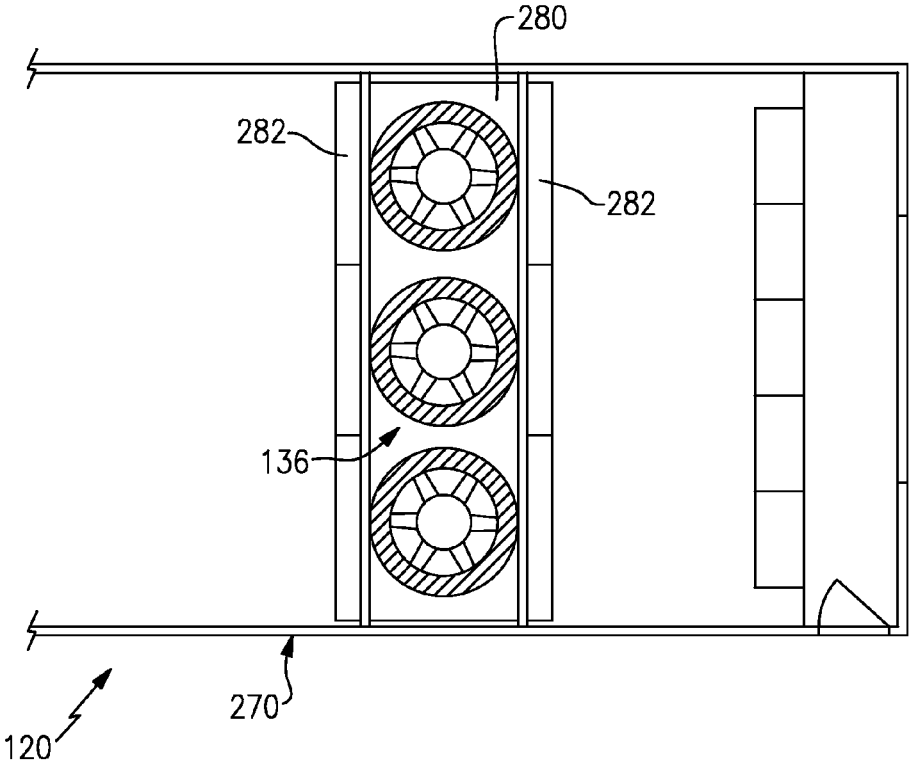
FIG. 9 shows another example plenum box for use with the air handling device of FIG. 5.

FIG. 9 illustrates a modified plenum box 270 that may be used instead of the plenum box 170 in the air handling device 120. In this example, the plenum box 270 includes an opening 280 through which air from the fans 136 is received. The air entering into the plenum box 270 is then forced through filters 282 before being discharged into the building or other structure from the plenum box 270.

Although a combination of features is shown in the illustrated examples, not all of them need to be combined to realize the benefits of various embodiments of this disclosure. In other words, a system designed according to an embodiment of this disclosure will not necessarily include all of the features shown in any one of the Figures or all of the portions schematically shown in the Figures. Moreover, selected features of one example embodiment may be combined with selected features of other example embodiments.

The preceding description is exemplary rather than limiting in nature. Variations and modifications to the disclosed examples may become apparent to those skilled in the art that do not necessarily depart from the essence of this disclosure. The scope of legal protection given to this disclosure can only be determined by studying the following claims.

What is claimed is:

1. An air handling device comprising:

a fan including a fan hub and a set of fan blades that extend from the fan hub, the set of fan blades defining a fan diameter and the fan hub defining a hub diameter, wherein the fan has an inlet side for air intake and an outlet side for air discharge;

an annular fan inlet passage arranged at the inlet side of the fan; and an annular fan outlet passage arranged at the outlet side of the fan, the fan inlet passage and the fan outlet passage each defining an outer diameter that is substantially equivalent to the fan diameter and an inner diameter that is substantially equivalent to the hub diameter, wherein the annular fan inlet passage and the annular fan outlet passage each extend over a diametrical distance from the outer diameter to the inner diameter and over an axial length, the diametrical distance being constant over the axial length, and wherein the axial length is greater than the diametrical distance.

2. The air handling device as recited in claim 1, wherein at least one of the annular fan inlet passage and the annular fan outlet passage includes at least one vane extending from the inner diameter to the outer diameter.

3. The air handling device as recited in claim 1, wherein the fan is an axial flow fan.

4. An air handling device comprising:

a plurality of fans each including a fan hub and a set of fan blades that extend from the fan hub, each set of fan blades defining a fan diameter and each fan hub defining a hub diameter, wherein each fan has an inlet side for air intake and an outlet side for air discharge;

a plurality of housing portions respectively arranged at the inlet sides of the fans, each housing portion defining an internal cylindrical space that has a diameter that is substantially equivalent to the fan diameter of the corresponding fan; and a plurality of air guide members that each include a cylindrical portion and a portion extending from the cylindrical portion that gradually increases in diameter, the cylindrical portions respectively extending in the internal cylindrical spaces to define annular passages there between, each cylindrical portion defining an outer diameter that is substantially equivalent to the hub diameter of the corresponding fan, wherein each annular passage extends over an axial length and over a diametrical distance, wherein the diametrical distance is from the outer diameter of the cylindrical portion to the diameter of the internal cylindrical space, the diametrical distance being constant over the axial length, and the axial length is greater than the diametrical distance.

5. The air handling device as recited in claim 4, wherein the plurality of fans are arranged side-by-side.

6. The air handling device as recited in claim 4, including at least one vane arranged in at least one of the annular passages, the at least one vane extending from the outer diameter of the corresponding cylindrical portion to the diameter defined by the corresponding housing portion.

7. The air handling device as recited in claim 4, wherein the plurality of fans are axial flow fans.

8. The air handling device as recited in claim 4, wherein the plurality of fans are generally enclosed within a housing that defines an inlet and an outlet where the plurality of fans are arranged to move air between the inlet and the outlet, and the housing includes therein a perforated surface and a liner material backing the perforated surface.

9. The air handling device as recited in claim 4, including a plenum box arranged downstream from the plurality of fans, the plenum box including a filter therein and at least one grated-inlet arranged to receive air flow from the fans.

10. The air handling device as recited in claim 4, including a plurality of dampers arranged in a one-to-one correspondence with the annular passages and operable to control flow of air to into the corresponding one of the plurality of fans.

11. The air handling device as recited in claim 4, wherein the plurality of fans are generally enclosed within a housing that defines an inlet and an outlet where the plurality of fans are arranged to move air between the inlet and the outlet, and the housing includes an access window adjacent the plurality of fans that is sized to receive at least one of the plurality of fans there through.

12. The air handling device as recited in claim 11, wherein the plurality of fans are removably mounted in the housing.

13. The air handling device as recited in claim 12, wherein the plurality of fans each include a base having a sliding surface.

14. The air handling device as recited in claim 13, wherein the sliding surface comprises a low-friction material.

15. The air handling device as recited in claim 13, wherein the sliding surface comprises a castor.

* * * * *